United States Patent [19]

Arvai

[11] 4,440,196

[45] Apr. 3, 1984

[54] DOUBLE OPEN-SHED JACQUARD MACHINE FOR THE LIFTING OF WARP YARNS OF A LOOM

[75] Inventor: Tibor Arvai, Monte-Carlo, Monaco

[73] Assignee: Verdol S.A., Caluire, France

[21] Appl. No.: 309,969

[22] PCT Filed: Feb. 17, 1981

[86] PCT No.: PCT/FR81/00018

§ 371 Date: Oct. 5, 1981

§ 102(e) Date: Oct. 5, 1981

[87] PCT Pub. No.: WO81/02312

PCT Pub. Date: Aug. 20, 1981

[30] Foreign Application Priority Data

Feb. 18, 1980 [MC] Monaco ..... 1432

[51] Int. Cl.[3] ..... D03C 3/00; D03C 13/00

[52] U.S. Cl. ..... 139/59; 139/85; 139/319; 139/455

[58] Field of Search ..... 139/59, 55.1, 455, 68, 139/65, 319, 85

[56] References Cited

U.S. PATENT DOCUMENTS

| | | | |
|---|---|---|---|
| 1,511,456 | 10/1924 | Fuchs | 139/85 |
| 1,633,475 | 6/1927 | Carver | 139/319 X |
| 2,136,076 | 11/1938 | Fisher et al. | 139/455 |
| 2,136,090 | 11/1938 | Tandler et al. . | |
| 2,609,840 | 9/1952 | Murphy | 139/455 |
| 3,867,966 | 2/1975 | Wieland | 139/455 |
| 4,314,463 | 2/1982 | Fuchs | 139/85 X |

FOREIGN PATENT DOCUMENTS

| | | | |
|---|---|---|---|
| 300753 | 9/1932 | Italy | 139/59 |
| 2041990 | 9/1980 | United Kingdom | 139/59 |

*Primary Examiner*—James Kee Chi

*Attorney, Agent, or Firm*—Dowell & Dowell

[57] ABSTRACT

An open-shed Jacquard machine comprising multiple harness cords on each side of the layer of warp yarns of a loom, and each cord provided with an eyelet through which a corresponding warp yarn passes, the shed opening system comprising multiple modules each having pulleys respectively receiving in its groove one of the harness cords, harness cord displacement mechanisms on the modules to rotate the pulleys through angles sufficient to lift the cords, the shed opening modules being arranged on the loom in series of spaced rows with their displacement mechanisms facing away from each other and their pulleys facing toward each other, and the rows being progressively offset from each other in directions parallel to the warp yarns.

13 Claims, 12 Drawing Figures

FIG_1
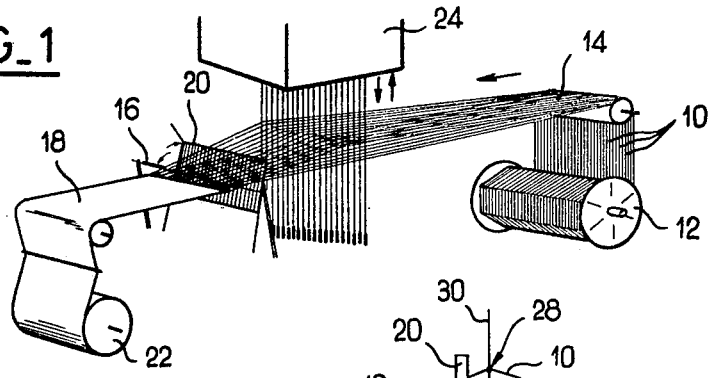
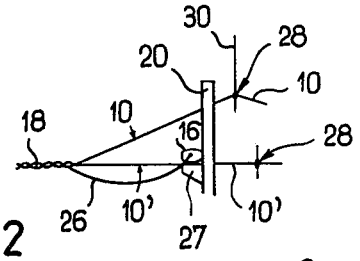
FIG_2
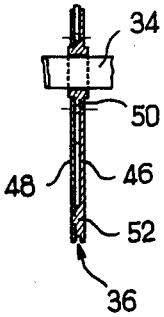
FIG_4
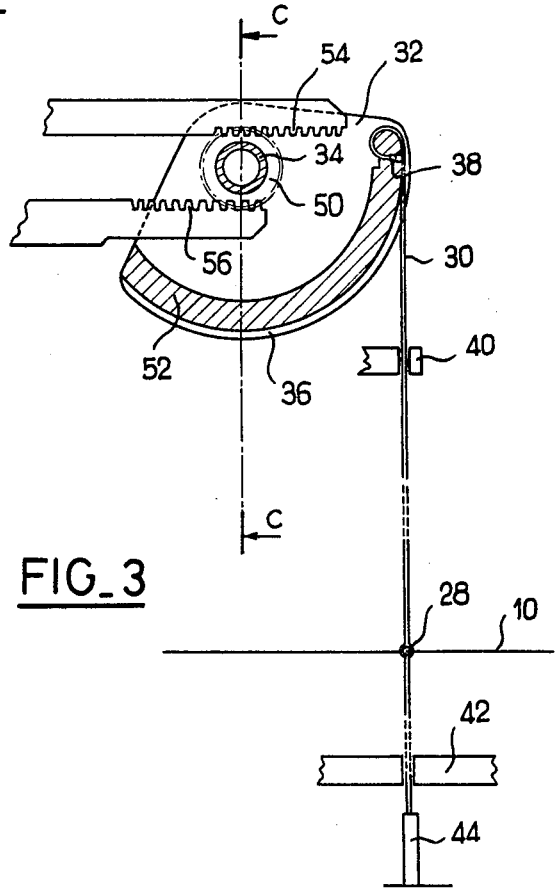
FIG_3

DOUBLE OPEN-SHED JACQUARD MACHINE FOR THE LIFTING OF WARP YARNS OF A LOOM

The present invention relates to a mechanical system for industrial weaving loom capable of making figured fabrics, as a Jacquard loom may do, in which a layer of parallel warp yarns is progressively advanced step by step, certain of the warp yarns selected by programming means as a function of the coloured pattern or the weave of the fabric to be made are raised at each step, a weft yarn is passed between the raised warp yarns and the non-raised warp yarns of the layer, the yarns or certain of the raised yarns are lowered and the weft yarn thus passed is pressed, by means of a reed, against the other weft yarns already woven, i.e. against the front of the fabric already made which, during this time, is wound on a reel or beam as the weaving program advances step by step.

This type of weaving loom for figured fabrics is of considerable interest as it makes it possible to make fabrics of infinite variety both concerning the texture or weave of the fabric and concerning the decoration made simply by the skilfully studied interlacing of the weft yarns and the warp yarns. The whole problem of making a pattern resides, at each weaving step, in the selection of those warp yarns which must be lifted before the passage of a determined weft yarn.

In order not to be limited in precision in making a design, particularly a coloured design, it should be theoretically possible to raise individually any of the warp yarns for the passage of a weft yarn, and this, moreover, is the basic principle of the Jacquard invention. However, in practice, the weave must be able to be very close, which leads to having such a small spacing between warp yarns that one can only lift several yarns at a time, even if the spacing of the warp yarns is increased at the place where the weft yarn passes or if one effects the equivalent of an increase in spacing of the warp yarns by raising them by harness cords stretched obliquely, diverging upwardly. In fact, the warp yarns must be raised by mechanisms whose dimensions have never yet been able to be reduced to correspond to a weaving which is as close as desired, whilst enabling a pattern to be woven over large widths (the present invention typically seeks to make a fabric width of 140 cm or more with 10 yarns to the millimeter, which has never been done before, with a view to making, for example, furnishing fabrics with a panoramic decoration rather than a decoration repeated several times in a fabric width as is done at present).

To effect this performance, as well as others, the present invention proposes a mechanical system for a weaving loom of the type described previously, i.e. comprising a system for advancing a plurality of wrap yarns disposed in a layer, a system for seletively raising selected warp yarns, coupled to means for programming the choice of the warp yarns to be raised, and a system for insertion of weft yarn between raised warp yarns and non-raised warp yarns, the system for raising the warp yarns comprising a plurality of harness cords (one per warp yarn) which are yarns stretched substantially perpendicularly to the layer of warp yarns, each harness cord comprising a loop or eyelet in which a warp yarn passes so that the warp yarn may be raised by traction on one end of the corresponding harness cord. According to the invention, each stretched harness cord moves away from the layer of warp yarns and passes in the groove of a respective pulley, individual harness cord displacement means being associated with the pulley to exert a traction on the cord and allow the cord to return, these means being disposed on the side opposite the side where the harness cord arrives on the pulley. In a preferred embodiment, the harness cord is hooked to the pulley and the individual displacement means are adapted to rotate the pulley through an angle corresponding to the desired height of lift of warp yarns.

These displacement means peculiar to each harness cord and each pulley are therefore rejected rearwardly of the pulley with respect to the harness cord inlet side, so that they do not form a bulky lifting mechanism above the harness cords and above the heddles of the warp yarns as was the case for the heretofore known mechanical systems.

By using small-width pulleys all placed side by side, a close-textured fabric may therefore be made by this means, closer than what would be achieved with a series of all other individual harness cord actuating devices placed side by side such as those which have been proposed since 1948 (U.S. Pat. No. 2,558,284).

Moreover, to divide the spacing of the warp yarns which may be raised individually, it is provided that rows of pulleys coupled side by side are superposed, i.e. placed at levels of different heights above the layer of warp yarns, whilst being slightly offset progressively from one level to the other in a direction parallel to the warp yarns. The harness cord inlet side of the pulleys of one row is immediately recessed with respect to the harness cord inlet side of the pulleys of the row immediately above, so that there is no risk of interference of the various harness cords between one another and with the pulleys or their means for rotation (the harness cord inlet sides constituting, moreover, the ultimate ends of each assembly of a pulley and its respective displacement means.) The density of the warp yarns is thus increased as desired by multiplying the number of superposed, offset rows of coupled pulleys.

To improve further, the possibility is even provided of having two series of rows opposite each other, i.e. opposite the superposed rows already described is disposed a series of other superposed, offset rows, but turned in the opposite direction from the first, i.e. the harness cord inlet sides of the pulleys of the first series are opposite the harness cord inlet sides of the pulleys of the other series, without any object in the interval between the two series (apart from the harness cords themselves). Right at the top, the opposite pulleys are close to one another. They move apart progressively the more one descends, since the progressive offsets between rows are opposite for the two series, and the harness cords descending from the pulleys of the higher levels pass therebetween.

To fix ideas, with two series of 25 rows each of 280 pulleys, a density of 14000 yarns over 140 cm is achieved with pulleys with a pitch of about 4.5 mm, which is perfectly feasible.

According to another particularly advantageous feature of the invention, aiming at reducing the energy expended at each step to raise all the selected warp yarns, a common drive means is provided for a plurality of pulleys (in practice one rotating shaft for all the pulleys of a row), and an individual coupling and uncoupling means between each pulley and the drive means, adapted to allow, or not, the rotation of the respective pulley with a view to raising a warp yarn, the assembly of the coupling and uncoupling means being controlled by the programming means.

Thus, only those pulleys of the yarns to be raised are driven and energy is not expended for moving a heavy mechanical system common to all the harness cords as was the case in the former Jacquard machines.

The individual coupling and uncoupling means is adapted to provoke rotation of the pulley either in a first direction up to a warp yarn lifting position, or in the opposite direction up to a warp yarn return position, the choice being made by the programming means.

According to an advantageous feature, a system for bistable positioning of the pulley is provided for maintaining it in that angular position where it was placed further to actuation of the coupling means, only a fresh actuation of the latter, in a direction of displacement of the pulley towards the other angular position being capable of provoking a rotation of the pulley.

This bistable positioning system comprises at least two catches for positioning of the pulley or of parts associated with the rotation of the pulley, these catches cooperating with a fixed frame for defining the two stable angular positions of the pulley, and a friction means acting between the frame and the pulley or the parts associated with the rotation of the pulley.

In a preferred embodiment, the coupling means comprises a thrust arm undergoing a reciprocating movement with a possibility of oscillation in a direction transverse to the reciprocating direction, a means for deviating the arm, actuatable by the programming means, being provided for orienting the direction of displacement of the arm, two thrust surfaces being provided, opposite one end of the thrust arm, these surfaces being associated with the rotation of the pulley so that the pulley rotates in one direction when the thrust arm pushes the first thrust surface and that it rotates in the other direction when the arm pushes the second thrust surface.

The thrust surfaces may each be located at the end of a respective rod of which the other end is connected to the pulley, this other end being located on one side of the axis of the pulley for one of the rods and diametrically opposite for the other rod.

The rods comprise at this other end a rack cooperating with a toothed pinion at the centre of the pulley, the two racks being diametrically opposite with respect to the axis of the pulley and the pinion, and the rods being mounted to slide, substantially in the general reciprocating direction of the thrust arm, with respect to a fixed frame bearing the shaft of the pulley.

Concerning the means for deviating the thrust arm, it preferably comprises a blade fast with the mobile armature of an electromagnet, this blade presenting at one end a bevelled surface and being capable of taking, according to whether or not the electromagnet is actuated, two positions of which at least one takes the bevelled surface on the path of a piece fast with the thrust arm in order consequently to deviate the movement thereof.

Finally, it is provided that the thrust arm is subjected to the action of a spring acting in the transverse direction of oscillation of the arm to return it in a position corresponding to one of the two directions of displacement of its end. The means for driving the thrust arm preferably comprise a shaft which permanently rotates and which bears, opposite the thrust arm, a pinion with interrupted toothing meshing with a rack made on the arm, a return spring serving to return it to an initial position after each displacement of this arm by the drive means. The rotating shaft drives, in principle a plurality of thrust arms each corresponding to a pulley and the shaft then comprises pinions with interrupted toothing opposite each thrust arm or it is splined over a length corresponding to a plurality of thrust arms.

Other characteristics and advantages of the invention will appear on reading the following detailed description which is made with reference to the accompanying drawings, in which:

FIG. 1 shows a general view in perspective of a weaving loom.

FIG. 2 shows a transverse schematic view showing the introduction of a weft yarn between the warp yarns.

FIG. 3 shows the individual warp yarn hooking and lifting mechanism according to the invention.

FIG. 4 shows a transverse section through a pulley of the mechanism according to the invention.

FIGS. 8*a* through 8*d* schematically show the advance movement of a thrust arm acting on a determined pulley, with the action of deviation by electromagnet of this thrust arm.

Figure 9:
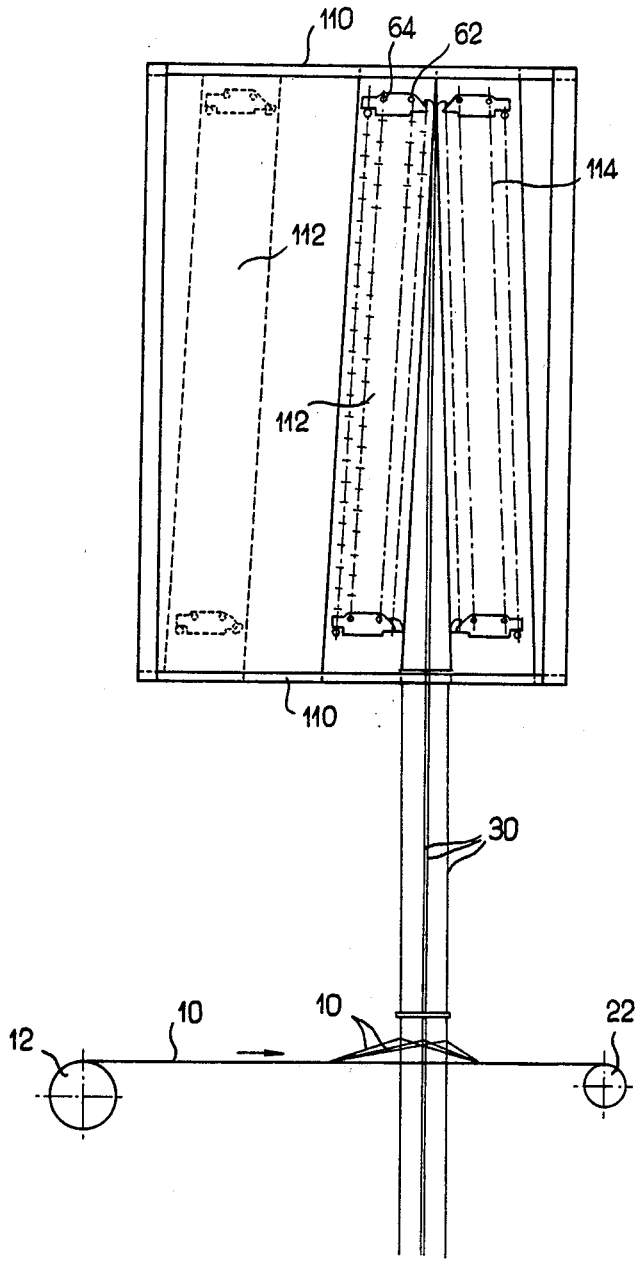

FIG. 9 shows the superposed disposition with longitudinal offset of the warp yarn lifting mechanism elements.

In order to enable the general scope of the invention to be understood, FIG. 1 shows a weaving loom such as exists at present, and which comprises a series of warp yarns 10 disposed parallel to one another and unwinding from a reel or "beam" 12 on which they were previously wound before the weaving operation. The side-by-side warp yarns are brought into a flat layer 14 where weaving takes place, i.e. where the successive weft yarns will be inserted perpendicularly to the warp yarns and passing above certain warp yarns and below certain others so as to make an interlacing and imbrication of the weft yarns and the warp yarns; the configuration of this interlacing possibly varies with each weft yarn inserted so that a desired weaving pattern may be made by programmation of this interlacing.

Each weft yarn inserted by a shuttle 16 is pushed against the yarns already inserted, i.e. against the front of the web of fabric 18 already made, by a reed 20 which may move longitudinally from front to rear.

The fabric 18 made is wound on another reel or beam 22.

To make a particular configuration of interlacing of weft yarns and warp yarns, a warp yarn lifting mechanical system 24 is provided which is capable of lifting each of the warp yarns individually and which is coupled to programming means (not shown) which control this system at each weaving step in order to select those warp yarns which must be raised at this step. The weft yarn is inserted between the raised warp yarns and the non-raised warp yarns.

FIG. 2 shows a transverse view of the opening between the warp yarns, with a raised warp yarn 10 and a non-raised warp yarn 10', the fabric 18 already formed, the weaving shuttle 16 which takes along the weft yarn 26 by moving perpendicularly to the warp yarns over a slide way 27. Each warp yarn passes in an eyelet or mail 28 fixed to a respective harness cord (or harness cord) 30, this harness cord being hooked on one side to the lifting system 24 and on the other side to a counterweight, spring or other tension means; each harness cord 30 may be raised individually by the system 24 to raise the warp yarn passing in its respective eyelet 28.

FIG. 3 shows the harness cord hooking system according to the invention. It comprises a pulley 32 mounted to rotate about a fixed shaft 34. The cord 30 passes in a groove 36 in the pulley and it is hooked to the pulley, for example due to a retaining swell 38 at its end, which swell prevents the cord from escaping from a hole in which it passes.

As shown in FIG. 3, the cord 30 preferably passes below the pulley in a hole formed in a fixed guide 40 which comprises a series of such holes for correctly positioning, side by side, each of the harness cords descending from a respective pulley. This guide 40 replaces the upper harness board provided heretofore in the lifting systems of the Jacquard type. At the bottom of the harness cord 30 is seen the eyelet 28 in which the respective warp yarn 10 passes, and below the warp yarn, the harness cord 30 passes in another fixed guide 42, regularly pierced like guide 40 for also positioning the harness cords at the bottom. The cord tensioning system is designated by reference 44.

FIG. 4 schematically shows the pulley in transverse section. This pulley in fact comprises, in the present case, virtually only a little more than a quarter pulley taking into account the height of yarn which is to be raised, this facilitating the insertion of pulley drive means at the shaft thereof. The pulley is in fact made of two parallel cheeks 46 and 48 between which is placed, around the shaft 34 of the pulley, a toothed pinion 50 whose toothing is located between the cheeks. The groove 36 is made by providing a circular part 52 forming spacer element between the cheeks 46 and 48.

The pulley is driven upwardly or downwardly due to the toothed ring 50 also visible in FIG. 3, this toothed ring cooperating with two racks 54 and 56 with linear movement, each passing on one side of the toothed ring 50 and working in phase opposition, i.e. when the rack 54 is pushed, the rack 56 is pulled and vice versa, in order that the rotation of the pulley in one direction is effected by pushing one of the racks and its rotation in the other direction is effected by pushing the other rack. The racks 54 and 56 are in the form of a thin plate, toothed at their end facing the ring 50, and they are inserted between the cheeks 46 and 48, which is possible since it has been provided that the pulley extends only over a portion slightly greater than a quarter circle, or more exactly since the part forming spacer element 52 and score 36 extends only over this portion by a little more than a quarter circle, the cheeks themselves being able to extend over the whole of a circular surface.

The radius of the groove 36 is chosen taking into account the height which each warp yarn must be raised (10 to 15 centimeters about), so that a rotation of the pulley through an angle of about a quarter revolution provides the rise of the yarn over the desired height.

As may be seen in FIG. 3, the means for rotating the pulley (racks 54 and 56) are disposed on the side of the pulley opposite the side where the harness cord arrives on the pulley with respect to the plane containing the geometric axis of said pulley so that, in practice, the harness cord is located completely at the end (in the longitudinal sense of the warp yarns) of the mechanical element for lifting this cord, the space beyond the point of contact between the yarn 30 and the pulley being left free for possible passage of other warp yarns. The only elements slightly projecting beyond the cord 30 are on the one hand the end edges of the cheeks 46 and 48 defining the groove 36 and on the other hand the end of the guide 40.

Figure 5:
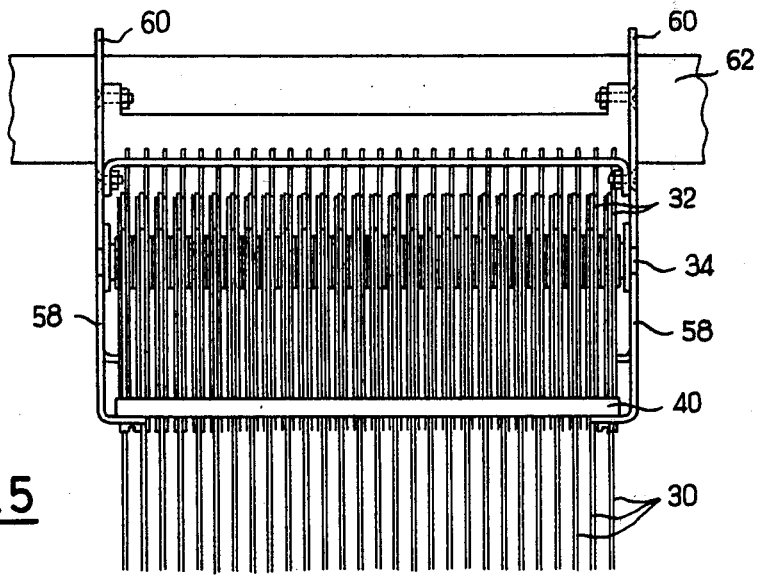
FIG. 5 shows the juxtaposition in a compact module of a series of warp yarn lifting pulleys.

FIG. 5 shows how a plurality of pulleys 32, each corresponding to the raising of a respective cord 30, could be assembled side by side. All the pulleys are mounted on a common shaft 34 which is carried by a frame 58 also bearing the guide 40. The frame 58 is a frame for a module comprising a certain number of juxtaposed pulleys with their respective individual systems for driving in rotation. This module is mounted on a general frame of the lifting system and, in the present case, the frame 58 comprises two cheeks 60 each pierced with two openings for the passage of two transverse guides of which one, 62, is visible in the front view of FIG. 5 and the other, 64, is visible in the other Figures. The module carried by a frame 58 is mounted to slide on the guides 62 and 64 and may therefore be displaced parallel to the plane of the warp yarns and perpendicularly to the longitudinal direction of the latter.

Figure 6:
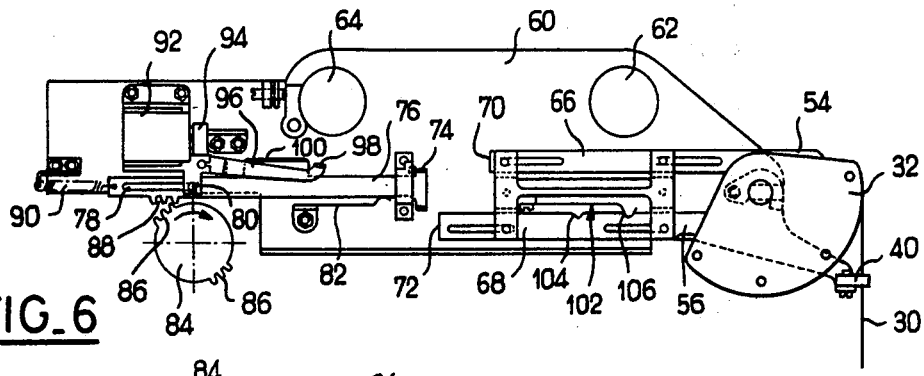
FIG. 6 shows in longitudinal section a warp yarn lifting mechanism element according to the invention.

FIG. 6 shows in greater detail a complete individual element of the mechanical system for traction and descent of a harness cord 30.

The harness cord shown in low position here is hooked to the pulley 32 and passes in the guide 40 placed under the pulley, in a hole located in line with the tangent vertical to the groove 36 of the pulley.

The racks 54 and 56 for driving the pulley 32 are carried at the end of respective rods 66 and 68 bearing horizontal guide grooves cooperating with guide lugs connected to the fixed frame 60 carrying the pulley and its actuating mechanism, so that the rods 66 and 68 may move parallel to each other and substantially perpendicularly to the direction of arrival of the cord 30, by being placed on the other side of the pulley with respect to this cord 30. The movements of the two rods 66 and 68 are completely associated with each other via the toothed ring of the pulley 32, and these movements are always in phase opposition, since the racks 54 and 56 mesh on either side of the toothed ring of the pulley.

The rods 66 and 68 are constituted by thin plates which may penetrate between the cheeks of the pulley 32. Their respective ends 70 and 72 on the side opposite the pulley and the racks 54 and 56 constitute thrust surfaces on which the end 74 of a thrust arm 76, capable of moving in a reciprocating motion in the direction of guide of the rods 66 and 68, may be applied.

The thrust arm 76 is guided by a groove 78 and a lug 80 in order to be able to move in this direction, but it may also oscillate in a direction transverse with respect to this direction, under the effect of a means for deviating the thrust arm, in order to be able to orient either in one position where its reciprocating movement brings its end 74 opposite the thrust surface 70 of the rod 66 without touching the end 72 of the rod 68, or in a position where its reciprocating movement beings its end 74 opposite the thrust surface 72 of the rod 68 without touching the end 70 of the rod 66. It is preferably provided that a return spring 82 acts on the thrust arm 74 to bring it permanently in one of the two positions, for example the first, so that, if the arm deviation means is not actuated, it is the rod 66 which may be pushed, whilst, if the arm deviation means is actuated, it will act against the spring 82 to displace the end 74 towards the thrust surface 72 of the rod 68.

The reciprocating movement of the thrust arm 76 is provoked by a drive shaft 84 which rotates permanently and which comprises at its periphery an interrupted toothing 86 capable of meshing with a toothed rack 88 provided on the thrust arm 76, the arm 76 being subjected to the action of a return spring 90 abutting on the frame 60 and tending to maintain it to the rear, spaced apart from the thrust surfaces 70 and 72 of the rods.

When the shaft 84 rotates, the portion of interrupted toothing 86 meshes at a certain moment with the rack 88 and advances the arm 76 against the spring 90. As soon as the portion of interrupted toothing 86 is finished, the arm returns to the rear under the action of the spring 90, whilst awaiting a further passage of a portion of interrupted toothing 86. A plurality of portions of toothing may be provided over a circumference of the shaft 84, provided that such portions of toothing are separated by a sufficient gap to allow the thrust arm 76 to return rearwardly before the passage of the following portion of toothing.

The drive shaft 84 is of course synchronised with the step-by-step advance movement of the fabric and therefore of the weft yarn passing means so that the thrust arm 74 undergoes a complete reciprocating motion at each weaving step, one of the movements serving for the possible rise of a warp yarn, and the other for the possible return of this warp yarn. In the example shown, two portions of toothing 86 are provided and the shaft 84 therefore makes a half-revolution at each weaving step.

The means for deviating the thrust arm 76 are constituted by an electromagnet 92 whose mobile armature 94 bears a blade 96 presenting at its end 98 a bevelled surface capable of taking two positions, depending on whether or not the electromagnet is actuated. At least one position brings the bevelled surface on the path of a piece 100 fast with the thrust arm to consequently deviate the movement of the latter and bring its end 74 opposite one of the rods 66 and 68. Here, when the electromagnet is excited, the bevelled surface lowers the end 74 to bring it opposite the surface 72 of the lower rod 68. In the absence of excitation of the electromagnet, the thrust arm can only be applied against the thrust surface 70 of the upper rod 66.

The piece 100 forms a bridge over a sufficient distance above the end 98 of the blade 100 so that once this piece 100 is engaged either above or below the end 98, it remains there for the whole duration of the path of the thrust arm in the direction of the rods, which making it possible to excite the electromagnet only during the beginning of a reciprocating cycle of the arm 76, in order to reduce the consumption of electrical energy by the electromagnets in the course of the weaving cycles.

The thrust arm 76, like the rods 66 and 68, is constituted by a thin plate in order to have lateral dimensions which are as small as possible and, preferably, the thrust arm, including part 100 which forms bridge above the blade 98, has a thickness substantially of the order of thickness of the pulley and is disposed in a plane aligned with that of the pulley.

The coupling of the thrust arm 76 with one or the other of the rods is effected as desired due to the electromagnet 92 which is, of course, controlled by the means programming the weaving loom.

Since, in certain cases, it is desired to be able to keep a warp yarn raised during several consecutive weaving steps, it is provided according to the invention that the rods 66 and 68 may be maintained by a bistable positioning system in the last position where they were placed by the thrust arm 76, so that, at the following weaving step, the rods remain in the same position without being actuated again by the thrust arm 76 if there is no need to modify the position of the warp yarn in question.

The bistable positioning system is simply constituted by a spring 102 fixed to the frame 60 and cooperating with catches 104 and 106 provided on at least one rod and defining the two angular positions which the pulley may take, raised position or return position of the warp yarn; the end of the spring 102 is adapted to engage in one of the catches 104 and 106 and then exerts on the rods a sufficient friction in the longitudinal direction to prevent rotation of the pulley towards its other stable angular position, for example under the effect of the tension of the harness cord 30.

Figure 7:
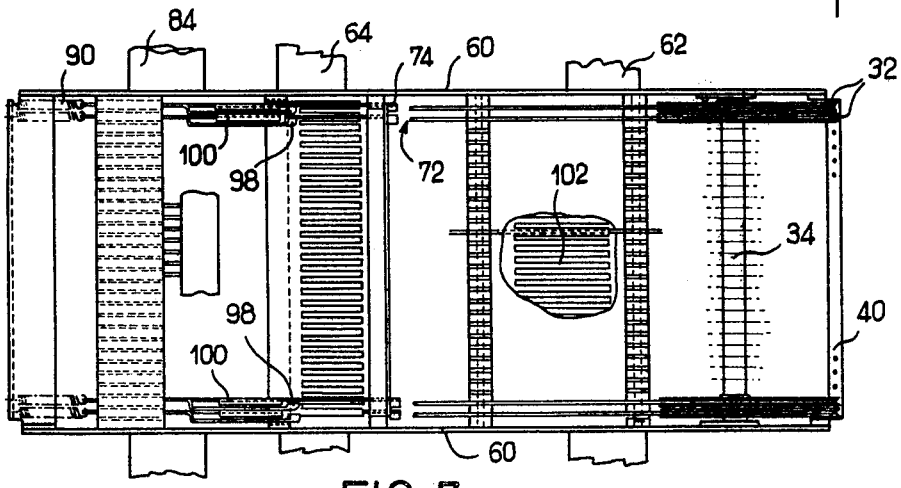
FIG. 7 shows a plan view of a plurality of mechanism elements such as that of FIG. 6, juxtaposed to form a module.

FIG. 7 shows a plan view of a group of mechanical elements for actuating a plurality of pulleys 32 located side by side. The pulleys and their respective mechanisms are in fact preferably disposed in compact modules comprising for example twenty or thirty juxtaposed pulleys, all the mechanical elements being rejected rearwardly of the pulleys, i.e. on the side opposite the side where the harness cords 30 arrive.

The frame 58 already mentioned is the frame on which are mounted the various mechanical elements and the respective pulleys. It is preferably provided that this frame 58 is not fixed with respect to the assembly of the frame of the system, but that, on the contrary, the modules may be displaced laterally with respect to one another; a row of modules is constituted, mounted on parallel bars 62 and 64 already mentioned with reference to FIG. 5 and these modules may be slid on the bars so as to bring them closer to or further from one another depending on the desired density of warp yarns for the weave.

As may be seen in FIG. 7, the pulleys 32 of a module are all mounted on a common shaft 34 so that the front edges of the pulleys are aligned and all the harness cords 30 are located in the same plane right at the front of the module (only the front edge of the guide 40 projecting slightly beyond the plane of the cords 30 since these harness cords pass in the holes of the guide 40).

Figure 8A:
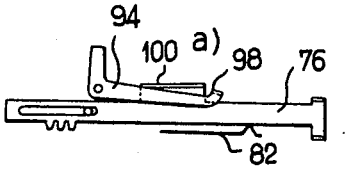
Figure 8B:
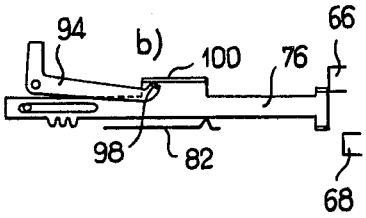
Figure 8C:
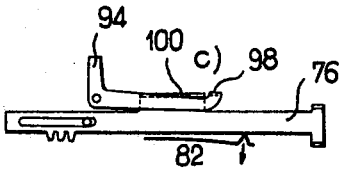
Figure 8D:
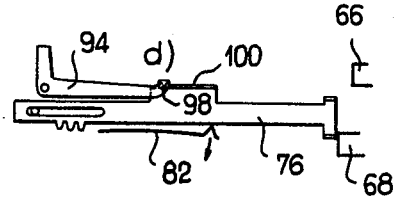

FIGS. 8*a* to 8*d* show, in order to render the description clear, the manner in which the means for deviating the thrust arm 76 works: in FIGS. 8*a* and 8*b*, the electromagnet is not excited and its mobile armature drops into a position in which the bevelled end 98 is not on the path of the part 100 fast with the thrust arm. The latter therefore moves in a first direction towards which it is urged by its spring 82; in this direction, it may touch the end of the upper rod 66 but not that of the lower rod 68. In FIGS. 8*c* and 8*d*, the electro magnet is excited and the bevelled surface 98 of the mobile armature comes on the path of the part 100 and forces the arm 76 to move downwardly in the course of its advance movement. In this new position, the end of the thrust arm 76 may abut on the rod 68 but not on the rod 66. It should be understood, in any case, that the thrust arm pushes on a rod 66 or 68 only if this rod has not already been pushed, at the preceding weaving half-step, by the thrust arm. An embodiment has thus been described, with reference to the preceding Figures, of a warp yarn lifting mechanism in which each harness cord 30 is hooked to a pulley which is driven in rotation by rods and racks acting on a toothed ring of this pulley. It may be understood that it is also possible not to hook the harness cord 30 directly to the pulley but to pass it over the groove of the pulley to return it in a direction to the rear of the side of the pulley where the cord 30 arrives, the cord then being hooked to an individual traction mechanism, the pulley serving only as direction guide for the cord 30; for example, the rods 66 and 68 do not necessarily act on a toothed ring of the pulley but simply on an independent toothed ring located between the rods 66 and 68 to connect their respective movements in phase opposition, the harness cord 30 being hooked to the end of one of the rods after having turned about the pulley through an angle of about 90°. It will be noted that it is then necessary to provide that the groove of the pulley extends over at least a semi-circumference and preferably a complete circumference, whilst in the preceding case, a quarter circumference was sufficient.

Taking into account the presently existing materials with low coefficient of friction, it may possibly be provided that the pulley 32 be, in this latter embodiment where it serves simply as guide, a fixed roller for example made of Teflon on which the harness cord 30 may slide without friction whilst being drawn by a rod rejected to the rear of the roller with respect to the side where the cord 30 arrives. In this latter case, it suffices to provide a roller having a groove extending over about a quarter circumference to allow the cord 30 to arrive vertically in this groove to be guided horizontally to be hooked to one of the rods arriving in alignment with the longitudinal displacement direction thereof, a gear further being provided to ensure synchronisation in phase opposition of the movements of the two rods.

The use of pulleys or rollers for guiding the direction of traction of the harness cords in a direction substantially perpendicular to the direction of arrival of these cords makes it possible to arrange a very large number of individual lifting mechanisms each associated with a respective pulley, without interference between the multiple harness cords and these mechanism elements, due to the arrangement which will now be described with reference to FIG. 9.

FIG. 9 shows the overall construction of the system for raising the warp yarns 10 which arrive in a layer from the reel 12 and which are wound, after being woven, on a reel 22, each warp yarn being able to be raised by a respective harness cord 30 descending from the lifting system. The latter comprises a general frame 110 which essentially carries two mobile assemblies 112 and 114 each carrying a series of rows of modules of a plurality of individual yarn raising system elements. The harness cords 30 are suspended from the pulleys of the modules of each series 112 and 114 and these harness cords pass between the two mobile assemblies 112 and 114, the direction of mobility of the assemblies 112 and 114 with respect to each other being the general direction of the warp yarns and this mobility being provided simply to allow the assemblies to be spaced apart from each other and to allow a man to pass between the assemblies with a view to maintaining and repairing the harness cords and the elements of the system.

FIG. 9 shows in broken lines the assembly 112 spaced apart from assembly 114, and in solid lines the assembly 112 close to the assembly 114. FIG. 9 also shows that the modules of the two series 112 and 114 are turned in opposite directions, so that they face each other and that the harness cords which are suspended therefrom are located between the two mobile assemblies, the system elements being reversed in the two series and oriented to extend outside the space between the harness cords facing each other.

Each mobile assembly comprises a series of a plurality of rows of modules such as those of FIG. 7, the rows being superposed in tiers and each row comprising a plurality of tiered modules carried by common parallel bars 62 and 64 on which the modules may slide as has already been said.

The superposed rows of modules are slightly offset progressively with respect to one another in a direction parallel to the warp yarns, the offset being made, furthermore, in opposite direction for the two series of the assemblies 112 and 114. This offset is made in a direction such that the pulleys of one row have their harness cord arrival side immediately recessed with respect to the harness cord arrival side of the pulleys of the row immediately above. In this way, the opposite pulleys are close to each other at the top of the general frame 110 and they progressively move away from each other on descending, the pulleys of the lower row being the furthest away from one another in the direction of the warp yarns.

The purpose of this progressive offset, which may exist both in the case of one assembly 112 being provided and in the case of two assemblies 112 and 114 being provided, is to ensure that not only the harness cords are not all located in the same plane but in slightly offset planes which facilitate separation of the cords from one another, but also that the cords coming from the higher rows do not drop on parts of the system for lifting the yarns of the rows which are below, the offset always being made in the same direction from one row to the row immediately below.

The progressive offset must not be too considerable from one row to the following row in order not to spread out the lifting points of the warp yarns (in the direction of the warp yarns) too much. The progressive offset must, however, be sufficient to avoid any interference between the harness cord coming from one row and the harness cords coming from the row immediately underneath: in particular, an offset must be provided which is at least sufficient for a harness cord 30, passing in a guide 40 which corresponds to this yarn, not to touch the front edge of a guide 40 (or the front edges of the cheeks of the pulleys) of the row immediately underneath the row in question.

By way of example, 25 rows of pulleys may be provided on each of the opposite assemblies, each row comprising 10 sliding modules and each module comprising 28 pulleys. However, the invention enables this number to be increased further both by increasing the number of the modules juxtaposed laterally and by increasing the number of superposed rows.

It must moreover be understood that the preceding description has been given only by way of example and that it in no way limits the field of the invention, the replacement of the details of execution described by any other equivalents not departing from the scope of the invention.

I claim:

1. An open-shed jacquard machine having programming means for controlling in cycle with a loom a plurality of harness cords on either side of a layer of warp yarns, and each cord being provided with an eyelet through which a corresponding warp yarn passes, comprising:

(a) shaft means supporting a plurality of modules having pulleys and each pulley having a groove receiving a corresponding one of the harness cords which is fixed thereto;

(b) individual harness cord displacing means controlled by said programming means and associated with each pulley and operative when actuated to rotate the pulley through an angle corresponding with the desired lift of the harness cord;

(c) each harness cord displacing means being located on the opposite side of the shaft means from the side where the pulley receives the harness cord;

(d) said modules being disposed in rows which are tiered above the layer of warp yarns, the successive rows being offset progressively from one tier to the next in a direction parallel to the warp yarns; and (e) the machine having two series of rows of modules disposed opposite to each other, said pulleys and the displacement means of the two opposed series being oriented in opposite directions extending parallel to the direction of the warp yarns, the harness-cord receiving sides of the pulleys facing toward each other and the offsets of the rows of modules progressing symetrically and oppositely in directions parallel to the warp threads.

2. In a jacquard machine as claimed in claim 1, each harness cord displacing means further comprising a rotating shaft, means under the control of the programming means for selectively coupling drive from the shaft to the pulley to rotate in one direction to raise the harness cord and selectively coupling the drive from the shaft to the pulley to rotate it in the other direction to return the harness cord.

3. In a jacquard machine as claimed in claim 2, wherein the coupling means comprises two coupling rods operative to drive the pulley for rotation in selected opposite directions, the machine further including bistable positioning means operative on the coupling means to maintain the coupling means and associated pulley in either the raised or the returned position until driven by a rod to the other position.

4. In a jacquard machine as claimed in claim 3, the bistable means comprising a friction catch for each coupling rod operative to retain the associated rod in position after it has driven the pulley to said raised or said returned position, thereby to retain the pulley in that position.

5. In a jacquard machine as claimed in claim 3, each coupling rod being reciprocable to drive the pulley, and the harness cord displacing means further comprising a thrust arm reciporcated by the shaft in synchronism with said cycle, the thrust arm being transversely displaceable under the control of the programming means to abut a selected one of the two rods to drive the pulley either to said raised position or to said returned position.

6. In a jacquard machine as claimed in claim 5, the two rods being disposed to drive diametrically opposite sides of the pulley to rotate the pulley in opposite directions in response to abutment by the thrust arm against one or the other of said rods.

7. In a jacquard machine as claimed in claim 6, each pulley comprising a toothed pinion concentric therewith on the shaft means, and each rod comprising a rack, the racks engaging diametrically opposite sides of the pinion and being selectively driven by the trust arm to rotate the pulley.

8. In a jacquard machine as claimed in claim 6, each harness cord displacing means further comprising an electromagnet connected to be energized by the programming means, the electromagnet having a mobile armature supporting a blade extending therefrom and having a portion of the blade moveable between two operative positions depending on whether or not the electromagnet is energized, one operative position transversely deflecting the thrust arm to a position to abut one of the rods, and the other operative position transversely deflecting the thrust arm to a position to abut the other of the rods.

9. In a jacquard machine as claimed in claim 8, each harness cord displacing means further including a spring operative upon the thrust arm to maintain it normally in one of said two operative positions.

10. In a jacquard machine as claimed in claim 8, each harness cord displacing means further comprising means engaged between the blade and the thrust arm and operative to maintain an operative position of the thrust arm once deflected, whereby the electromagnet need be energized during only part of the reciprocation of the thrust arm.

11. In a jacquard machine as claimed in claim 5, the thrust arm comprising a rack, and the shaft having interrupted toothed segments thereon operative to drive the thrust arm toward said rods synchronously with said cycle, and means operative on the thrust arm to return it to a rest position between drives by said interrupted segments.

12. In a jacquard machine as claimed in claim 11, said return means being a spring operative to return the thrust arm away from said rods.

13. In a jacquard machine as claimed in claim 7, each pulley further comprising two spaced cheek members receiving the pinion therebetween, and said rods comprising plates which extend between said cheek members and engage the pinion.

* * * * *